US007377616B2

(12) United States Patent
Sakurai

(10) Patent No.: US 7,377,616 B2
(45) Date of Patent: May 27, 2008

(54) INKJET PRINTER INCLUDING DISCHARGER WITH CAP

(75) Inventor: Hisaki Sakurai, Aichi-ken (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 321 days.

(21) Appl. No.: 11/223,546

(22) Filed: Sep. 9, 2005

(65) Prior Publication Data

US 2006/0050105 A1 Mar. 9, 2006

(30) Foreign Application Priority Data

Sep. 9, 2004 (JP) ..... 2004-262633

(51) Int. Cl.
*B41J 2/165* (2006.01)

(52) U.S. Cl. ..... 347/29; 347/22; 347/30; 347/32

(58) Field of Classification Search ..... 347/22, 347/29, 30, 32
See application file for complete search history.

(56) References Cited

U.S. PATENT DOCUMENTS 5,504,508 A * 4/1996 Hashimoto ..... 347/24
6,491,370 B2 * 12/2002 Momose ..... 347/30
6,702,422 B1 3/2004 Suzuki et al.
7,244,013 B2 * 7/2007 Harada et al. ..... 347/29

FOREIGN PATENT DOCUMENTS

JP 2001253095 9/2001

* cited by examiner

*Primary Examiner*—Manish S. Shah
*Assistant Examiner*—Mark J Stevenosky
(74) *Attorney, Agent, or Firm*—Reed Smith LLP

(57) ABSTRACT

An inkjet printer includes: (a) a head unit having ejecting portions and operable to eject a plurality of kinds of inks through the ejecting portions; (b) a discharger for discharging the inks through the ejecting portions; and (c) a communication controller. The discharger includes: (b-1) a cap selectively placeable in a contact state in which the cap is held in contact with the head unit, and in a separate state in which the cap is separated from the head unit; (b-2) a suction pump; and (b-3) a connector connecting the cap and the suction pump. The cap defines therein ink storage chambers in which the respective kinds of inks are to be stored. The connector includes passage definers defining respective discharge passages each communicating the corresponding ink storage chamber and a chamber of the suction pump. The communication controller allows communication between at least two of the ink storage chambers when the cap is placed in the separate state, and inhibits the communication between the at least two ink storage chambers when the cap is placed in the contact state.

16 Claims, 9 Drawing Sheets

INKJET PRINTER INCLUDING DISCHARGER WITH CAP

This application is based on Japanese Patent Application No. 2004-262633 filed in Sep. 9, 2004, the content of which is incorporated hereinto by reference

BACKGROUND OF THE INVENTION

1. Field of the Invention

The present invention relates to an inkjet printer equipped with an ink discharger which is operable to discharge an waste ink from a head unit of the inkjet printer.

2. Discussion of Related Art

An inkjet printer, using an inkjet principle, is easily adapted to meet a demand for a high gradation or colorization, owing to simplicity of the principle. Thus, the inkjet printer is easily arranged to perform not only a monochrome printing operation but also a full-color printing operation, by employing an ink head unit coping with a plurality of different color inks. Such an inkjet printer could suffer clogging of nozzles of an ink head unit with a thickened or dried ink sticking to or accumulated in the nozzles. There is known an inkjet printer equipped with a waste ink discharger which is operable to discharge the ink through the nozzles at a predetermined cycle or as needed, for recovering an ink ejection performance of the head unit. The waste ink discharging operation is carried out, for example, by sucking the ink through the nozzles.

As the ink commonly used in the inkjet printer, there are a pigment ink and a dye ink. The pigment ink is dried or solidified easier than the dye ink. In the inkjet printer equipped with the conventional ink discharger, the pigment ink and the dye ink are sucked through respective receiver caps as the conventional ink discharger which are arranged to cover a nozzle opening surface of the head unit, for sucking the inks through the nozzles. That is, the pigment ink and the dye ink are discharged independently of each other.

Since the pigment ink is easily dried and solidified, the pigment ink could be easily solidified in the receiver cap and/or in a tube connected to the receiver cap, thereby making it difficult to sufficiently generate a suction pressure for sucking the waste inks. In view of such a problem, there is proposed an arrangement, as disclosed in U.S. Pat. No. 6,702,422 (or corresponding to JP-2001-253095A), in which a pigment-ink receiver cap is arranged to receive the dye ink as well as the pigment ink, so that a mixture of the inks which is hardly dried and solidified is sucked by a suction pump connected to the receiver cap, so as to be discharged toward a chamber of the suction pump. In this arrangement, the pigment-ink receiver cap is arranged to first receive the pigment ink and then receive the dye ink, thereby requiring movement of one of the receiver cap and the head unit relative to the other, after receipt of the pigment ink and before receipt of the dye ink. Thus, the arrangement requires a large length of time for receiving the inks.

SUMMARY OF THE INVENTION

The present invention was made in view of the background prior art discussed above. It is therefore an object of the invention to provide an inkjet printer which is equipped with a head unit arranged to eject a plurality of kinds of inks, and which is capable of reliably discharging waste inks from the head unit by a single sucking action, and constantly maintaining a condition required for a normal ink ejection.

This object may be achieved according to any one of first through fourth aspects of the invention which are described below.

The first aspect of the invention provides an inkjet printer including: (a) a head unit having a plurality of ejecting portions and operable to eject a plurality of kinds of inks through the plurality of ejecting portions, respectively; (b) a discharger operable to discharge the plurality of kinds of inks through the plurality of ejecting portions of the head unit; and (c) a communication controller. The discharger includes: (b-1) a cap selectively placeable in a contact state in which the cap is held in contact with the head unit, and in a separate state in which the cap is separated from the head unit; (b-2) a suction pump operable to generate a suction pressure within the cap; and (b-3) a connector connecting the cap and the suction pump. The cap defines therein a plurality of ink storage chambers in which the respective kinds of inks are to be stored. The connector includes a plurality of passage definers defining respective discharge passages each of which communicates a corresponding one of the ink storage chambers and a chamber of the suction pump. The communication controller allows communication between at least two of the plurality of ink storage chambers when the cap is placed in the separate state, and inhibits the communication between the at least two ink storage chambers when the cap is placed in the contact state.

In the present inkjet printer, at least two kinds of inks can be simultaneously received by the cap, and then the inks can be mixed into each other by operation of the communication controller which is arranged to allow the communication between the ink storage chambers when the cap is separated from the head unit. Thus, the above-described at least two kinds of inks can be discharged toward the chamber of the suction pump via the discharge passages, after having being mixed into each other. Therefore, even where the above-described at least two kinds of inks include an ink that is easily dried and solidified, such an easily dried and solidified ink is mixed into another kind of ink that is hardly dried and solidified, so that the inks can be reliably discharged as a mixture that is hardly dried and solidified as a whole.

According to the second aspect of the invention, in the inkjet printer defined in the first aspect of the invention, the cap has a partition wall by which the at least two ink storage chambers are separated from each other, wherein the communication controller selectively allows and inhibits the communication between the at least two ink storage chambers through the partition wall.

According to the third aspect of the invention, in the inkjet printer defined in the second aspect of the invention, the communication controller is provided by the partition wall which defines a communication through-hole establishing therethrough the communication between the at least two ink storage chambers, such that the communication through-hole is open when the cap is placed in the separate state and is closed when the cap is placed in the contact state.

The fourth aspect of the invention provides an inkjet printer including; (a) a head unit having a plurality of ejecting portions and operable to eject a plurality of kinds of inks through the plurality of ejecting portions, respectively; and (b) a discharger operable to discharge the plurality of kinds of inks through the plurality of ejecting portions of the head unit. The discharger includes: (b-1) a cap selectively placeable in a contact state in which the cap is held in contact with the head unit, and in a separate state in which the cap is separated from the head unit; (b-2) a suction pump operable to generate a suction pressure within the cap; and (b-3) a connector connecting the cap and the suction pump. The cap defines therein a plurality of ink storage chambers in which the respective kinds of inks are to be stored. The cap has a partition wall by which a first chamber as one of the plurality of ink storage chambers and a second chamber as another of the plurality of ink storage chambers are separated from each other. The connector includes a passage definer defining a discharge passage which communicates one of the first and second chambers and a chamber of the suction pump. The partition wall defines, in a lower portion thereof, a communication through-hole establishing therethrough a communication between the first and second chambers, such that an ink as one of the plurality kinds of inks stored in the other of the first and second chambers, as well as an ink as another one of the plurality of kinds of inks stored in the one of the first and second chambers, can be discharged through the discharge passage.

In the inkjet printer constructed according to the fourth aspect of the invention, the communication through-hole may be held always open, and the connector connecting the cap and the suction pump may be provided only by the passage definer defining the discharge passage which communicates the above-described one of the first and second chambers and the chamber of the suction pump. This inkjet printer does not require an arrangement for selectively opening and closing the communication through-hole and a passage definer defining a discharge passage which communicates the other of the first and second chambers and the chamber of the suction pump, whereby the inkjet printer can be manufactured at a lower cost.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

Pig. 9 is a cross sectional view of the cap in an arrangement according to still another embodiment of the invention, in which the cap is provided with a valve mechanism to close a discharge passage that communicates one of the ink storage chambers.

DETAILED DESCRIPTION OF THE PREFERRED EMBODIMENTS

Figure 1A:
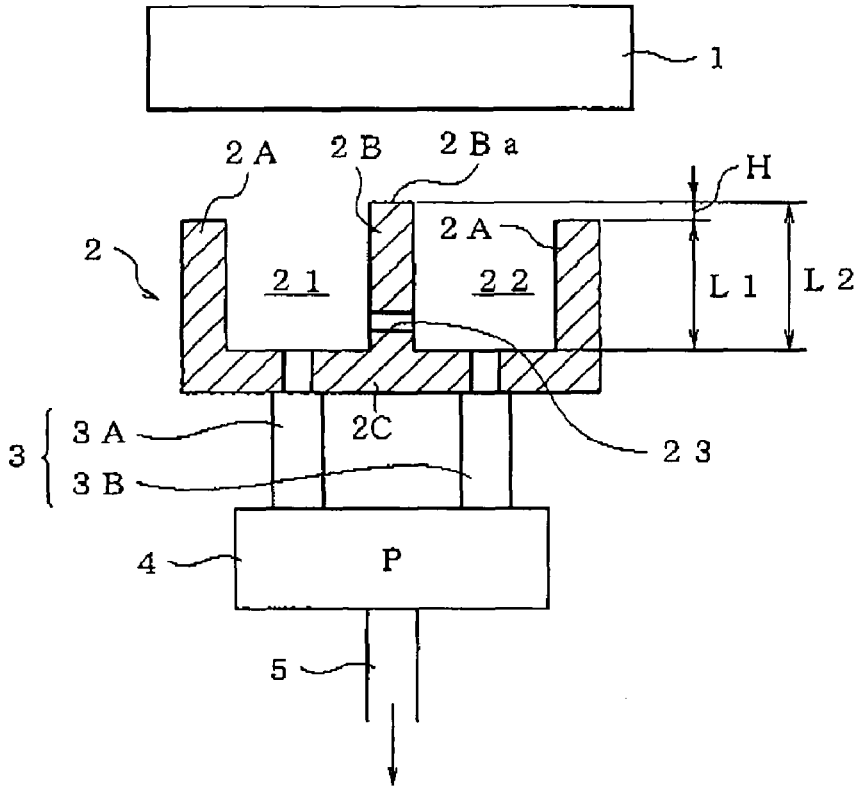
FIG. 1A is a schematic view of an arrangement according to an embodiment of the invention, showing a separate state in which a cap is separated from an head unit.

Referring to the drawings, there will be described embodiments constructed according to the invention.

Figure 5:
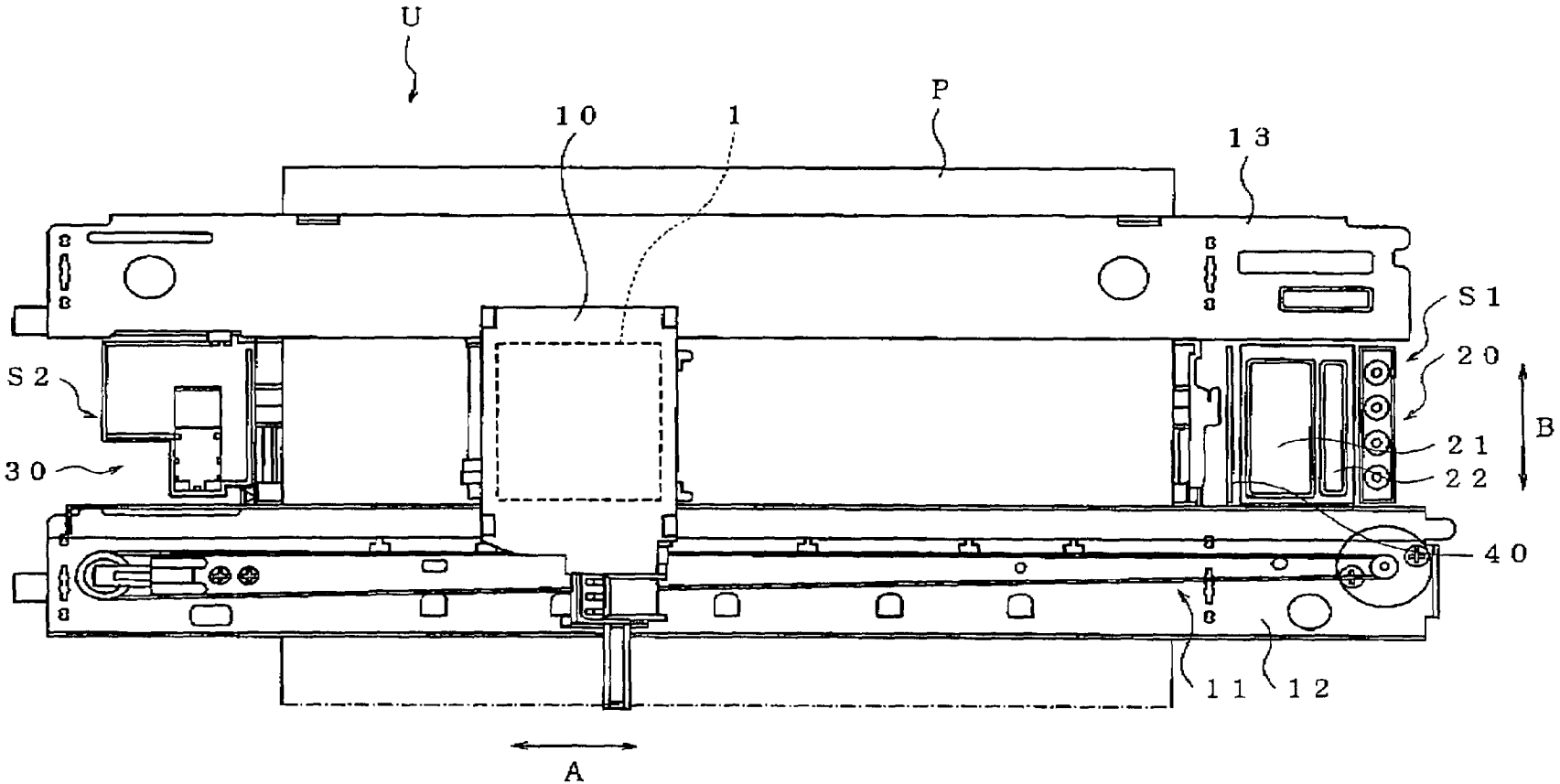
FIG. 5 is a plan view schematically showing an inkjet printer equipped with the head unit.

FIG. 5 shows an example of an inkjet printer U, which includes a carriage 10 arranged to be moved in right and left directions of a surface of a paper sheet P as a recording medium (i.e., directions of arrows A in FIG. 5). Reference numeral "11" denotes a drive device for reciprocating the carriage 10 in the directions of the arrows A. Reference numerals "12" and "13" denote a pair of guide members for supporting the carriage 10 such that the carriage 10 is slidable thereon.

The carriage 10 carries a head unit 1 having a multiplicity of nozzles opening in a plurality of ejecting portions of its nozzle opening surface which is to be opposed to the paper sheet P. That is, the head unit 1 is provided to be opposed to the surface of the paper sheet P, so that a printing operation can be performed onto an entirety of the surface of the paper sheet P, by causing the carriage 10 to be reciprocated in the directions of the arrows A while the paper sheet P is fed in directions of arrows B perpendicular to the directions of arrows A.

The carriage 10 carries ink cartridges, too, such that the ink cartridges are movable together with the carriage 10. However, the carriage 10 does not necessarily have to carry the ink cartridges, but may be arranged such that the head unit 1 receives inks through ink supply tubes from ink tanks which are disposed in a stationary portion of the printer U.

The printer U has maintenance stations located in its end portions which are opposed to each other as viewed in the direction of movement of the carriage 10. In the maintenance stations, the head unit 1 is subjected to operations for recovering or maintaining an ink ejection characteristic of the head unit 1. In the present embodiment, a right one (as seen in FIG. 5) of the maintenance stations provides a purging station S1, while a left one of the maintenance stations provides a flushing station S2.

In the purging station S1, the head unit 1 is subjected to a purging operation in which the inks as waste inks are sucked and discharged from an inside of the head unit 1, via a receiver cap 2 (see FIG. 1B) which covers the nozzle opening surface of the head unit 1. In this purging operation, air bubbles and other foreign matters remaining within the head unit 1, as well as the inks, are discharged from the head unit 1. In the flushing station S2, on the other hand, the head unit 1 is operated to eject a predetermined number of ink droplets through each of the nozzles, apart from the printing operation performed onto the paper sheet P. This flushing operation is effective to prevent increase of viscosity of the ink in each of the nozzles, even where there are some nozzles through each of which the ink is not ejected for a relatively large length of time. Thus, the purging and flushing operations are operations which are carried out, as needed, for assuring stability in the ink ejection characteristic.

In the purging station S1, as shown in FIG. 5, an ink discharger 20 is provided to discharge the inks from the head unit 1 through the nozzles, with application of a suction pressure to the inks. In the flushing station S2, an ink receiver 30 is provided to receive the inks ejected apart from the printing operation.

The ink discharger 20 is provided with a receiver cap 2 defining therein a dye-ink storage chamber 21 and a pigment-ink storage chamber 22 which are located to be adjacent to each other. The dye-ink storage chamber 21 is provided to store a dye ink, while the pigment-ink storage chamber 22 is provided to store a pigment ink containing a major component in the form of a pigment-based component.

The pigment ink is commonly used as a black ink, and is inherently easy to be dried and solidified. In the pigment ink, coloring material takes the form of particles dispersed in an ink liquid. When the particles are dried, a viscosity of the ink is likely to be increased, or the dried particles are likely to be agglomerated and stick in the nozzles. When the ink s initially introduced into the head unit 1 or when the ink cartridge is replaced with a new one, the above-described purging operation is carried out, for example, in accordance with an operator's command, so that the inks are sucked and discharged from the head unit 1 through the nozzles. However, there is a risk of clogging of drain passages (communicating the receiver cap and a drain tank) with the inks which remain in the drain passages and which are difficult to be discharged from the drain passages due to dry of the inks.

Figure 2A:
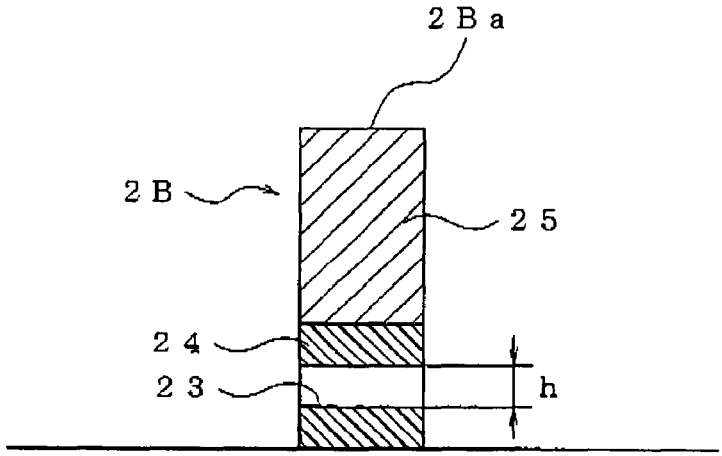
FIG. 2A is a cross sectional view of a partition wall of the cap, showing the separate state in which a communication through-hole formed through the partition wall is open.
Figure 2B:
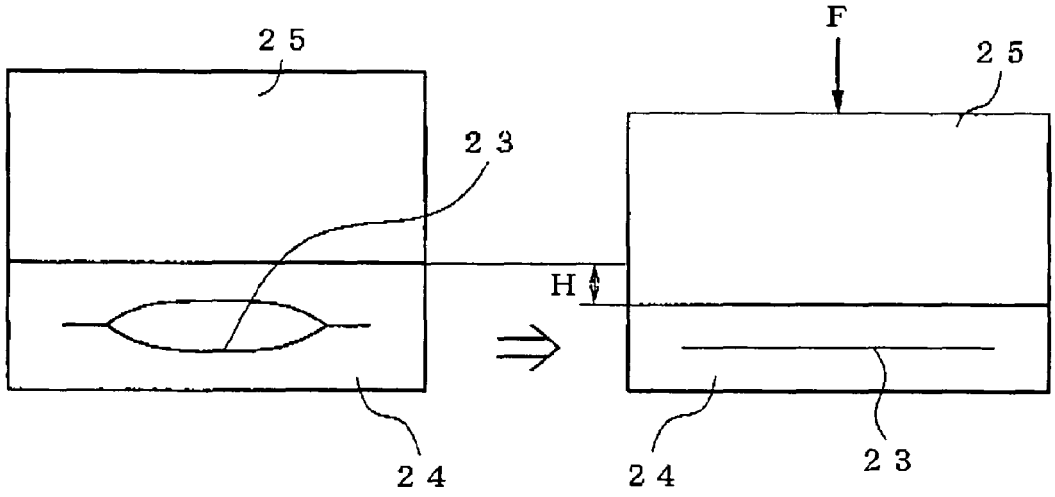
FIG. 2B is a set of front views of the partition wall of the cap, showing the separate state and the contact state in which the communication through-hole is open and closed, respectively.
Figure 3:
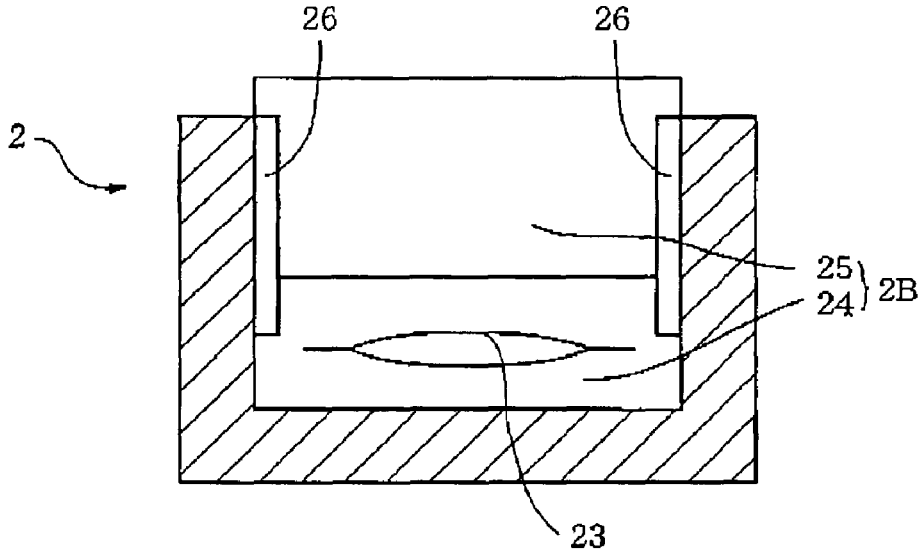
FIG. 3 is a cross sectional view of the cap in which the partition wall is arranged to be vertically slidable relative to a circumferential wall of the cap.

Referring to FIGS. 1-3, there will be described a construction of the ink discharger 20 according to an embodiment of the invention.

Figure 1B:
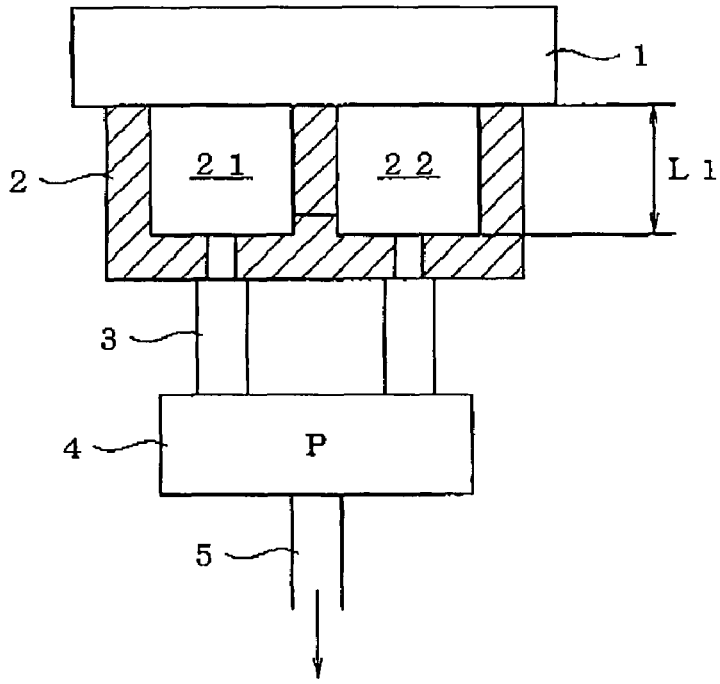
FIG. 1B is a schematic view showing a contact state in which the cap is held in contact with the head unit.

The ink discharger 20 includes, in addition to above-described receiver cap 2, passage defining pipes 3, a suction pump 4 and a waste ink tube 5, which are communicated with the drain tank (not shown). FIG. 1A shows a separate state of the cap 2 in which it is separated from the head unit 1, while FIG. 1B shows a contact state of the cap 2 in which it is held in contact with the head unit 1.

In the present embodiment, for enabling the cap 2 to be selectively held in contact and separated with and from the head unit 1 which is disposed above the cap 2, the cap 2 is arranged to be vertically movable toward and away from the head unit 1. However, the head unit 1 may be arranged to be movable toward and away from the cap 2, for establishing selectively the contact state and separate state.

The cap 2 is connected to the passage defining pipes 3A, 3B which serve as a connector connecting the cap 2 and the suction pump 4. The passage defining pipes 3A, 3B define respective ink discharge passages each of which communicates a corresponding one of the ink storage chambers 21, 22 and a chamber of the suction pump 4. The cap 2 has a circumferential wall 2A which surrounds the two chambers 21, 22, a partition wall 2B by which the two chambers 21, 22 are separated from each other, and a bottom wall to which the pipes 3A, 3B are connected. The partition wall 2B defines a communication through-hole 23 establishing therethrough a communication between the two chambers 21, 22, so that the different kinds of inks can be mixed into each other. In this sense, the partition wall 2B may be referred to as a communication controller.

During the purging operation, the cap 2 is held in contact with the nozzle opening surface of the head unit 1, and the inks are sucked and discharged toward the drain tank, by activation of the suction pump 4. In this instance, the communication through-hole 23 is closed by a valve portion of the partition wall 2B which serves to selectively open and close the through-hole 23. Therefore, the dye ink is received in the dye-ink storage chamber 21 and then discharged to an exterior of the inkjet printer U via the ink discharge passage defined by the pipe 3A. Meanwhile, the pigment ink is received in the pigment-ink storage chamber 22 and then discharged to the exterior of the inkjet printer U via the ink discharge passage defined by the pipe 3B. The suction pump 4 is kept activated, until a predetermined length of time has elapsed, or until predetermined amounts of the inks have been discharged. Even after the pump 4 has been stopped, the discharge of the inks continues for a while, since each of each of the chambers 21, 22 is not placed from its vacuum state to atmospheric state immediately after the stop of the pump 4. When a pressure in each of the chambers 21, 22 is substantially equalized to an atmospheric pressure, the cap 2 is separated from the head unit 1. Upon separation of the cap 2 from the head unit 1, the communication through-hole 23 is opened by the valve portion, so that the inks stored in the respective ink storage chambers 21, 22 are mixed into each other through the through-hole 23.

In the present embodiment, the partition wall 2B is made principally of a rubber (or material similar to the rubber) having a low rigidity and a high flexibility, so that the communication through-hole 23 is closed with the wall 2B being downwardly forced at its upper end 2Ba. The ink opening surface of the head unit 1, with which the cap 2 is to be brought into contact, is formed to be flat. The partition wall 2B has a height L2, which is larger than a height L1 of the circumferential wall 2A by an amount H (see FIG. 1). In other words, the partition wall 2B has an upper end 2Ba that is located an upper side of an upper end of each of two mutually opposed side walls. This arrangement causes the upper end 2Ba of the partition wall 2B to be brought into contact with the head unit 1 earlier than the upper end of the circumferential wall 2A, when the cap 2 is placed into the contact state from the separate state. The upper end 2Ba is displaced downwardly, i.e., toward the communication through-hole 23, so that the through-hole 23 is eventually closed (see FIG. 2B).

Further, the partition wall 2B is fixed at its lower end to the bottom wall 2C, while being held in fluid-tight contact at its opposite side ends with the circumferential wall 2A, such that the partition wall 2B is vertically slidable relative to the circumferential wall 2A. The partition wall 2B is guided at its opposite side end portions by respective guide portions 26 of the cap 2, as shown in FIG. 3. Each of the guide portions 26 is provided by a pair of vertically elongated protrusions which are formed in an inner surface of the circumferential wall 2A, such that a corresponding one of the opposite side end portions of the partition wall 2B is gripped by and between the vertically elongated protrusions of each guide portion 26 which are parallel to each other. The downward displacement of the upper end 2Ba of the partition wall 2B is facilitated by the sliding movement of the partition wall 2B relative to the circumferential wall 2A in the vertical direction.

In the ink discharger 20 constructed as described above, with upward movement of the receiver cap 2 toward the head unit 1, the partition wall 2B having the relatively large height of L2 is brought into contact at its upper end 2Ba with the head unit 1, earlier than the upper end of the circumferential wall 2A having the relatively small height L1. Then, with further upward movement of the cap 2, the upper end of the circumferential wall 2*a* as well as the upper end 2Ba of the partition wall 2B is brought into contact with the head unit 1. In this instance, the upper end 2Ba of the partition wall 2B is made substantially flush with the upper end of the circumferential wall 2A, as a result of reduction of the height of the partition wall 2B by the amount H. It is noted that the communication through-hole 23 has a width h (as measured in the vertical direction) or a diameter (where the through-hole 23 has a circular cross section), which is smaller than the above-described amount H, so that the through-hole 23 is reliably closed.

While the receiver cap 2 is held in contact with the head unit 1, the communication through-hole 23 is closed whereby the ink storage chambers 21, 22 are isolated from each other, so that the different kinds of inks are not mired into each other That is, there is no risk of communication between the nozzles assigned to eject therethrough the different kinds of inks, namely, there is no risk that the mixed inks would be ejected toward the recording medium. This feature is effective to prevent deterioration in quality of printed images, particularly, where the head unit 1 is arranged to use chromatic color inks. The communication through-hole 23 is opened when the cap 2 is separated from the head unit 1, whereby the ink storage chambers 21, 22 are brought into communication with each other. In this instance, the different kinds of inks are mixed into each other through the opened through-hole 23, namely, the inks are diluted by each other. This feature, particularly, where one of the inks is the pigment ink which tends to be easily dried and thickened so as to stick in the discharge passage, is effective to restrain such an undesirable tendency. That is, owing to this feature, the ink ejection characteristic of the head unit 1 can be maintained for a large length of time.

The partition wall 2B may be constituted in its entity by a material having a low rigidity and a high flexibility. In the present embodiment, however, the partition wall 2B includes a highly rigid portion in addition to an elastically deformable portion. The elastically deformable portion, which is elastically deformable easier than the highly rigid portion, is provided by a lower portion 24 of the partition wall 2B in which the communication through-hole 23 is formed, as shown in FIG. 2A. That is, the lower portion 24 serves as the above-described valve portion, by elastic deformation of which the through-hole 23 can be closed. Meanwhile, the highly rigid portion is provided by an upper portion 25 of the partition wall 2B. It is noted that the through-hole 23 is configured to be elongated in the horizontal direction and to have the width which is reduced in each of its horizontally opposite end portions, as shown in FIG. 2B. Such a configuration of the through-hole 23 facilitates the through-hole 23 to be easily closed by the lower portion 24 as the valve portion, in presence of a pressing force F downwardly exerted on the lower portion 24 (surrounding the through-hole 23) through the upper portion 25. The through-hole 23, which is thus closed in presence of the pressing force F, is held open in absence of the pressing force F.

The upper portion 25 provides the highly rigid portion which has a higher rigidity than the lower portion 24 and which causes the lower portion 24 to be elastically deformed, when the upper portion 25 is pressed downwardly by the pressing force F, namely, by the head unit 1, upon contact of the receiver cap 2 with the head unit 1. It is therefore possible to reliably open and dose the through-hole 23 having a large cross sectional area in spite of its small width. Further, since the sliding movement of the partition wall 2B relative to the circumferential wall 2A facilitates the downward displacement of the upper end 2Ba of the partition wall 2B which causes the through-hole 23 to be closed, the pressing force F may be provided by a small force, thereby contributing to simplification in construction of the ink discharger 20.

The size of the communication through-hole 23 is not particularly limited, as long as the size is large enough to enable the ink stored in each one of the ink storage chambers 21, 22, to flow into the other of the ink storage chambers 21, 22. Further, the communication through-hole 23 may be replaced with a plurality of communication through-holes each having a size smaller than that of the single through-hole 23. That is, the arrangement of the communication through-hole 23 may be modified as needed, as long as the modified arrangement enables the dye ink (difficult to be agglomerated even if dried) to flow into the pigment ink (easy to be agglomerated when dried).

Figure 7A:
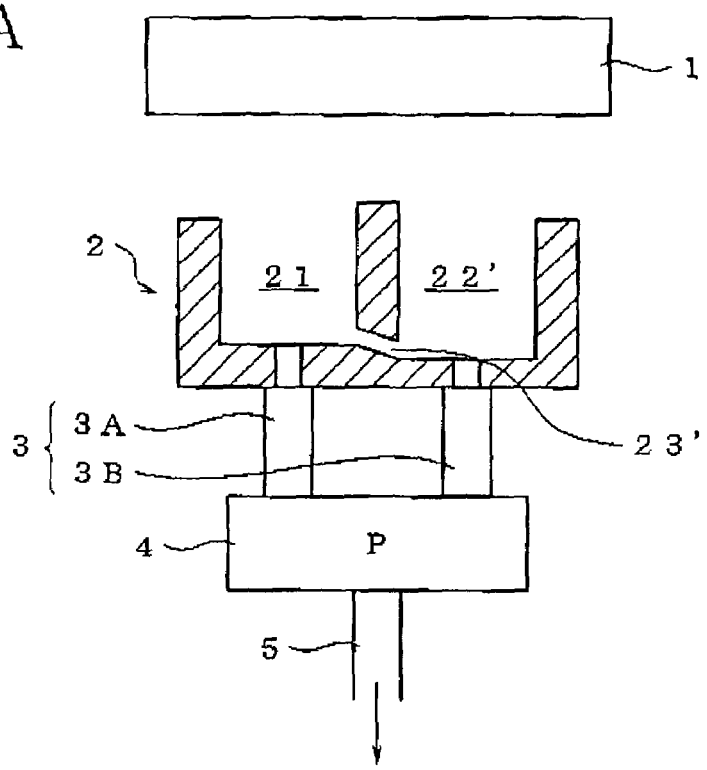
FIG. 7A is a schematic view of an arrangement according to a modification of the embodiment of the invention, showing the separate state in which the cap is separated from the head unit.
Figure 7B:
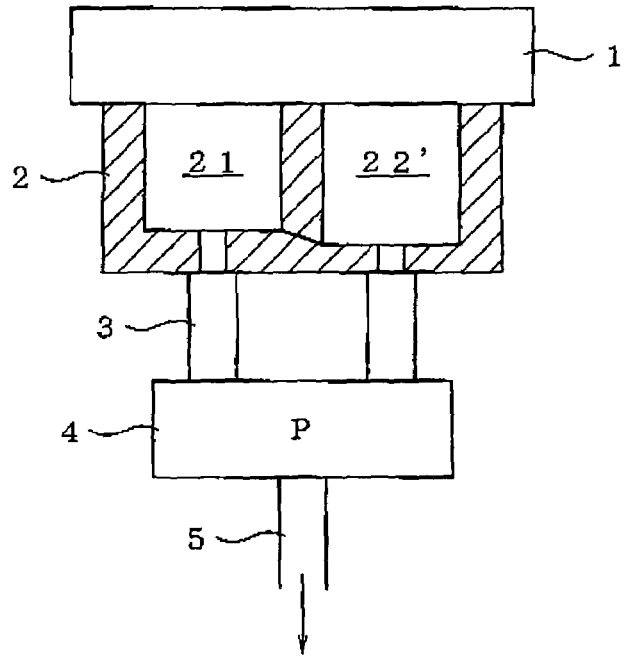
FIG. 7B is a schematic view showing the contact state in which the cap is held in contact with the head unit.

FIGS. 7A and 7B are views of a modification of the embodiment of the invention, wherein FIG. 7A shows the separate state in which in which the receiver cap 2 is separated from the head unit 1, while FIG. 7B shows the contact state in which the cap 2 is held in contact with the head unit 1. It is noted that the same reference numerals as used in FIGS. 1A and 1B are used to identify the same or similar elements in FIGS. 7A and 7B.

In this modification of the embodiment, a pigment-ink storage chamber 22' provided to store the pigment ink has a bottom surface lower than a bottom surface of the dye-ink storage chamber 21 provided to store the dye ink. Further, the ink storage chambers 21, 22' are communicated with each other via a communication through-hole 23', which is inclined such that its end portion connected to the pigment-ink storage chamber 22' is located on a lower side of its another end portion connected to the dye-ink storage chamber 21. In this arrangement, the ink flow between the two chambers 21, 22' is oriented in a direction away from the dye-ink storage chamber 21 having the higher bottom surface, toward the pigment-ink storage chamber 22' having the lower bottom surface, whereby the dye ink is caused to smoothly flow into the pigment-ink storage chamber 22', without the ink remaining in the communication through-hole 23' which communicates the two chambers 21, 22'. Thus, the dye ink can be reliably mixed into the pigment ink which is easy to be dried and solidified, thereby restraining the pigment ink from flowing toward the drain tank without the dye ink being mixed thereto.

In FIGS. 7A and 7B, the communication through-hole 23' is arranged such that its lower end is substantially flush with both of the bottom surfaces of the respective storage chambers 21, 22', so that the bottom surfaces of the two chambers 21, 22' are smoothly connected to each other through the inclined communication through-hole 23'. However, the through-hole 23' may be arranged such that its lower end is substantially flush with one of the bottom surfaces of the two chambers 21, 22' rather than with both of the bottom surfaces of the two chambers 21, 22', or alternatively such that its lower end is located between the bottom surfaces of the two chambers 21, 22' as viewed in the vertical direction, as long as the dye ink stored in the dye-ink storage chamber 21 can be spontaneously caused to flow toward the pigment-ink storage chamber 22'.

Figure 4A:
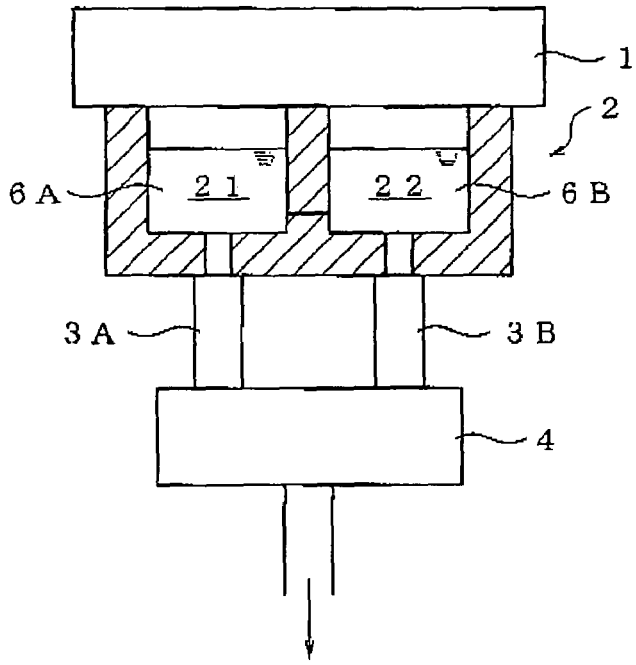
FIG. 4A is schematic view showing the contact state in which inks are received in respective ink storage chambers of the cap.
Figure 4B:
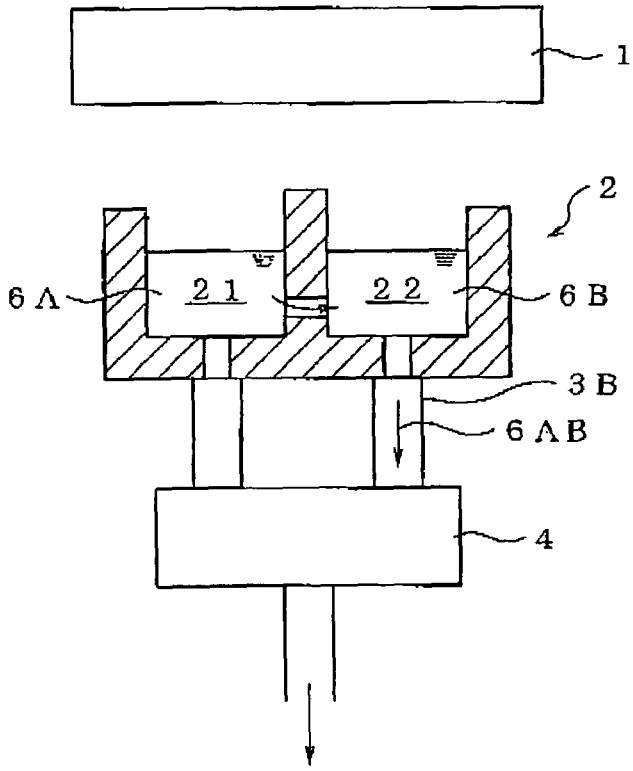
FIG. 4B is schematic view showing the separate state in which the inks received in the respective ink storage chambers are mixed into each other.

Referring next to FIGS. 4A and 4B, there will be described an operation to discharge the inks from the head unit 1. As shown in FIG. 4A, when the receiver cap 2 is brought into contact with the nozzle opening surface of the head unit 1, the communication through-hole 23 formed in the partition wall 2B is closed. While the receiver cap 2 is being thus held in the contact state, the suction pump 4 is activated, whereby the waste inks are sucked from the head unit 1 and received in the ink storage chambers 21, 22 of the cap 2. In this instance, the inks are drawn out through the nozzles, owing to the suction or vacuum pressure generated in the chambers 21, 22 by activation of the suction pump 4. The drawing of the inks through the nozzles continues for a while even after the pump 4 has been stopped, namely, while each of the chambers 21, 22 is held in its vacuum state, until the pressure in each of the chambers 21, 22 comes to substantially equal to the atmospheric pressure. Then, when the cap 2 is separated from the nozzle opening surface of the head unit 1, as shown in FIG. 4B, the communication through-hole 23 is opened, whereby the adjacent chambers 21, 22 are brought into communication with each other, as described above.

As a result of establishment of the communication between the two chambers 21, 22, the dye ink 6A which is difficult to be agglomerated even if dried and which is stored in the chamber 21 is allowed to flow into the chamber 22, so that the dye ink 6A cooperate with the pigment ink 6B which is easy to be agglomerated when dried and which is stored in the chamber 22, to constitute a mixed ink 6AB. With reactivation of the suction pump 4, the pigment ink 6B as a part of the mixed ink 6AB is caused to be discharged toward the drain tank, passing through the ink discharge passage defined by the passage defining pipe 3B.

A point of time at which the suction pump 4 is reactivated after the separation of the cap 2 from the head unit 1 can be suitably determined. The suction pump 4 may be reactivated after the dye ink 6A is so sufficiently mixed into the pigment ink 6B that the tendency of easy solidification of the pigment ink 6B is alleviated, or after the receiver cap 2 has been moved to a position in which the cap 2 does not impede movement of the carriage 10.

The mixed ink 6AB is less easy to be agglomerated when dried, than the pigment ink 6B. Thus, all the waste ink stored in the ink storage chambers 22 can be discharged, flowing through the ink discharge passage defined by the passage defining pipe 3B, while the ink passage defined by the passage defining pipe 3B is being cleaned or washed by the ink flowing therethrough.

For more reliably mixing the dye ink 6A and the pigment ink 6B into each other, namely, for more reliably causing the dye ink 6A and the pigment ink 6B to be discharged as the mixed ink GAB, it is preferable that the communication through-hole 23 is located in vicinity of the lower end of the partition wall 2B. However, the through-hole 23 may be located in any height position that is lower than a height of level of each of the inks 6A, 6B at a point of time of the separation of the cap 2 from the head unit 1, since the inks 6A, 6B continue to be discharged as the mixed ink 6AB once after the inks 6A, 6B begin to be mixed into each other.

Further, in the above-described embodiment as well as in the modification of the embodiment, it is possible to arrange such that the inks stored in the respective two chambers 21, 22 are all caused to be discharged through a predetermined one of the ink discharge passages defined by the respective passage defining pipes 3A, 3B. For example, where the dye ink 6A as well as the pigment ink 6B is caused to be discharged through the ink discharge passage which is defined by the passage defining pipe 3B and which faces the pigment-ink storage chamber (22, 22'), the dye ink 6A is forced to be mixed into the pigment ink 6B so as to be discharged as the mixed ink 6AB. In this arrangement, the pigment ink 6B is not discharged independently of the dye ink 6A, thereby making it possible to avoid undesirable solidification of the ink within the pigment-ink storage chamber (22, 22') and the ink discharge passage which is defined by the passage defining pipe 3B.

Described more specifically, the ink discharge passage defined by the passage defining pipe 3A may be arranged to be closed, when the suction pump 4 is reactivated after the separation of the receiver cap 2 from the head unit 1. For establishing such an arrangement, a valve mechanism capable of selectively opening and closing the ink discharge passage defined by the pipe 3A may be provided between the cap 2 and the suction pump 4. The valve mechanism is not limited to a particular mechanism, but may be provided by any standard valve mechanism that can be arranged to close the ink discharge passage before the reactivation of the suction pump 4. The valve mechanism may be provided by, for example, a valve body 46 and a coil spring 48 which will be described later (see FIG. 9). In the arrangement with the valve mechanism, when the suction pump 4 is reactivated, the inks are discharged through only the ink discharge passage defined by the passage defining pipe 3B That is, this arrangement is effective to reliably cause the dye ink 6A to flow into the pigment-ink storage chamber (22, 22'), so as to be discharged after being mixed into the pigment ink 6B. It is noted that the suction pump 4 is eventually stopped when the discharge of all the inks stored in the receiver cap 2 is completed.

The above-described purging operation is carried out, for example, in response to a command signal that is inputted through a switch by an operator, or is carried out automatically when a predetermined condition or conditions are satisfied. That is, the purging operation is effected at a predetermined timing, as needed, for recovering an ink ejection performance of the head unit 1.

The above-described flushing operation is carried out, for example, depending upon various conditions, prior to or during a printing operation performed onto the paper sheet P, or after the purging operation. In the flushing operation, the head unit 1 is operated to eject a predetermined number of ink droplets through each of the nozzles, apart from the printing operation.

With the purging and flushing operations being carried out, air bubbles and other foreign matters closing the nozzles of the head unit 1 are discharged together with the waste inks, from the head unit 1, so that the printing operation can be performed with high stability in quality of printed images. Thus, even where the pigment ink is used, the head unit 1 does not suffer reduction or clogging of the ink discharge passages communicating the ink storage chambers 21, 22 and the chamber of the suction pump 4, so that the suction pressure generated in the chamber of the suction pump 4 can sufficiently act on the inks within the head unit 1, for reliably recovering the ink ejection function of the head unit 1.

Figure 6:
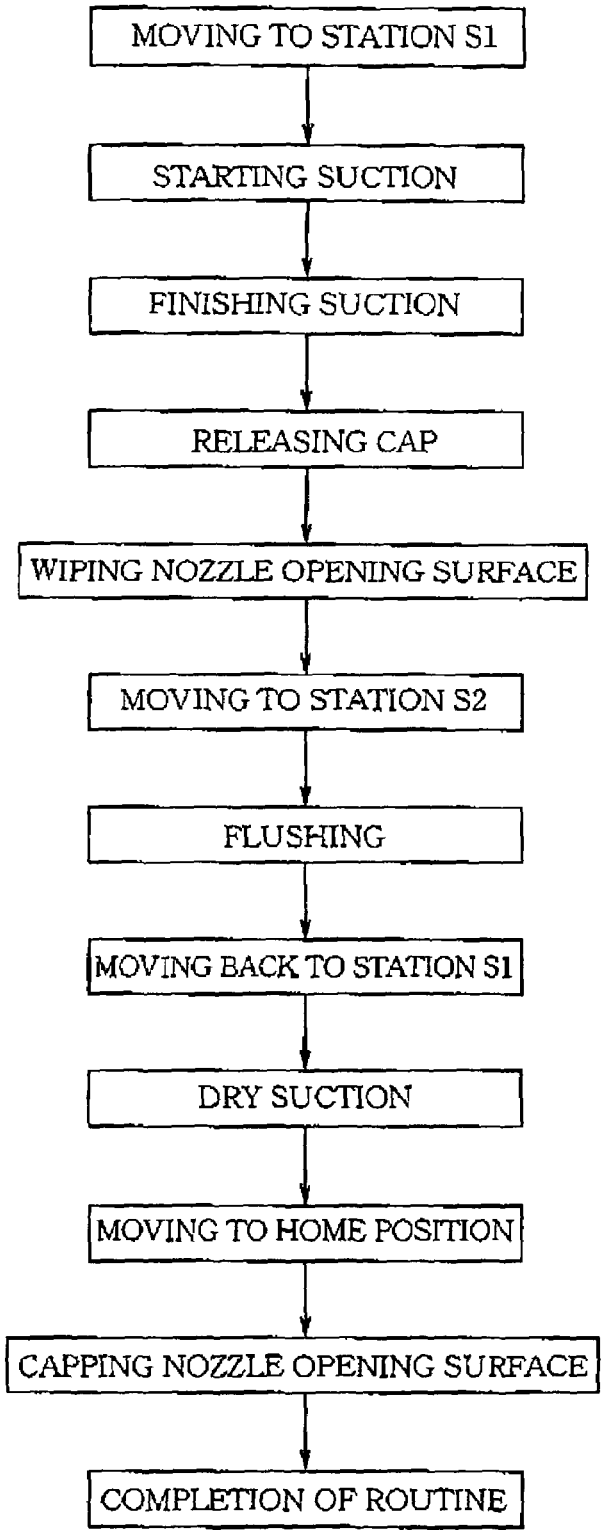
FIG. 6 is a flow chart showing a routine executed for maintenance of the head unit.

Referring next to a flow chart of FIG. 6, there will be described a routine executed for maintenance of the head unit 1.

In response to the operator's command requesting the purging operation to be carried out, the head unit 1 is first moved to the purging station S1. When it is determined that the head unit 1 has been moved to the purging station S1, the receiver cap 2 is moved upwardly to be brought into contact with the nozzle opening surface of the head unit 1. Upon determination that the contact of the cap 2 with the head unit 1, the suction pump 4 is activated to start suction of the waste inks. When the suction is finished, the cap 2 is released or separated from the head unit 1. After the separation of the cap 2 from the nozzle opening surface of the head unit 1, the nozzle opening surface is wiped by a wiper blade 40 (see FIG. 5) that is disposed apart from the head unit 1.

The wiper blade 40 is operated to wipe the head unit 1, after the cap 2 has been moved to a position that does not impede the movement of the carriage 10. That is, the head unit 1 is wiped by the wiper blade 40, while being moved by the carriage 10 toward a printing operation area, without the movement of the carriage 10 being impeded. After the wiping, the wiper blade 40 is moved to a position that does not impede the movement of the carriage 10, thereby completing one cycle of the purging operation. It is noted that, when the cap 2 is moved to be brought into contact with the head unit 1, the wiper blade 40 is also moved toward the head unit 1 and then waits for the suction to be finished.

The head unit 1 then is moved to the flushing station S2, so as to carry out the flushing operation. When the flushing operation is finished, the head unit 1 is moved back to the purging station SI, so as to be subjected again to the suction (dry suction).

After the dry suction has been finished, the nozzle opening surface of the head unit 1 is capped for preventing the inks within the head unit 1 from being evaporated or dried. For capping the nozzle opening surface, an additional cap member may be provided in addition to the receiver cap 2. However, it is preferable that the cap 2 is used for capping the nozzle opening surface, for eliminating necessity of provision of the additional member or device. Further, where the cap 2 is used for capping the nozzle opening surface, the head unit 1 can be positioned in the purging station S1 as its home position while being capped by the cap 2. That is, the purging station S1 serves also as the home position of the head unit 1, thereby permitting the inkjet printer U as a whole to be made compact in size.

The maintenance routine is executed as described above, for keeping the head unit 1 always capable of performing a printing operation by ejecting the inks through the nozzles formed through the nozzle opening surface, in response to an operator's printing command.

As is clear from the above description, in the present inkjet printer U for performing a full-color printing operation by using a plurality of different inks, the adjacent ink storage chambers 21, 22 are separated by the partition wall 2B including the lower portion 24 through which the communication through-hole 23 is formed. The lower portion 24 of the partition wall 2B, serving as the valve portion, is made of the material having a low rigidity and a high flexibility, so that the communication through-hole 23 is closed by the lower portion 24 as the valve portion when the receiver cap 2 is in contact with the head unit 1, and so that the through-hole 23 is opened by the lower portion 24 when the receiver cap 2 is separated from the head unit 1. The simple construction easily permits the different inks to be received by the respective ink storage chambers 21, 22 separately from each other, and then easily permits the different inks to discharged as the mixed inks difficult to be solidified, through the purging operation.

Therefore, even where the different inks are provided by the pigment ink and the dye ink, the pigment and dye inks can be received by the respective ink storage chambers 21, 22 separately from each other, and then can be discharged as the mixed inks difficult to be solidified, through the purging operation. Further, the purging operation (waste-ink discharging operation) can be reliably made by a single sucking action, and a condition required for a normal ink ejection can be constantly maintained, Referring next to FIGS. 8-10, there will be described other embodiments of the present invention. In the following descriptions as to the other embodiments, the same reference numerals as used in the above-described embodiment are used to identify the same or similar elements, and redundant description of these elements will not be provided.

Figure 8:
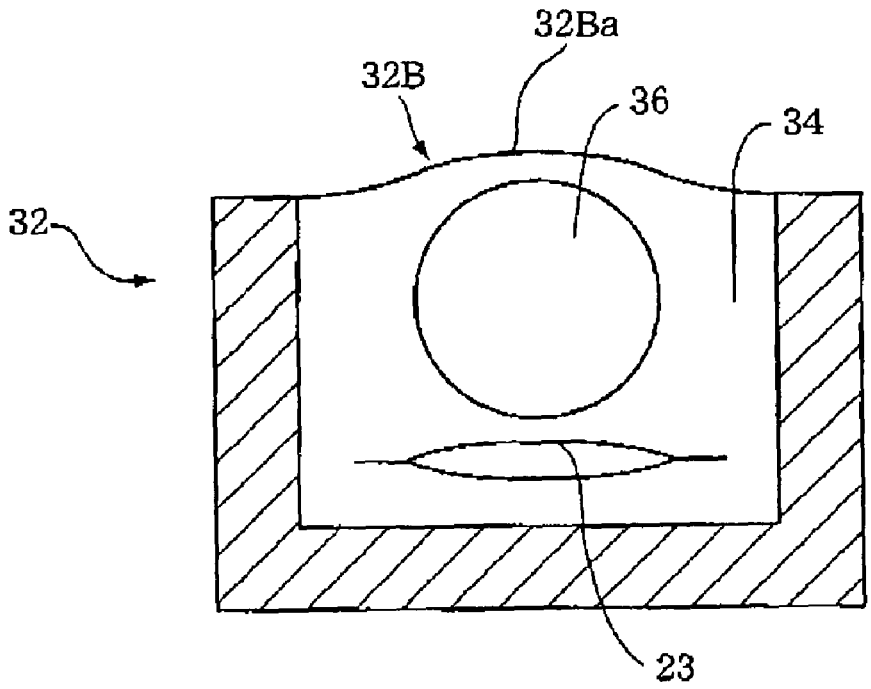
FIG. 8 is a cross sectional view of the cap in an arrangement according to another embodiment of the invention, in which the partition wall is fixed to the circumferential wall.

FIG. 8 shows another embodiment of the invention in which the above-described receiver cap 2 is replaced by a receiver cap 32 including a partition wall 32B. While the partition wall 2B of the above-described receiver cap 2 is held in fluid-tight contact at its opposite side ends with the circumferential wall 2A, the partition wall 32B is fixed at its opposite side ends to a circumferential wall of the receiver cap 32. That is, the partition wall 32B is fixed at its lower end to a bottom wall of the cap 32, and is fixed at its opposite side ends to the circumferential wall of the cap 32. Further, the partition wall 32B includes an elastically deformable portion 34 and a highly rigid portion 36 which has a higher rigidity than the deformable portion 34 and which is located right above the communication through-hole 23 formed through the deformable portion 34. The highly rigid portion 36 is provided by a highly rigid member which is embedded in the partition wall 32B and which has a higher rigidity than a material forming the deformable portion 34. The partition wall 32B has an upper end 32Ba which is upwardly convexed, such that a portion of the upper end 32Ba distant from the circumferential wall is located on an upper side of a portion of the upper end 32Ba close to the circumferential wall.

In the embodiment of FIG. 8, in spite of the absence of an arrangement allowing the sliding movement of the partition wall 32B relative to the circumferential wall of the cap 32, the communication through-hole 23 can be closed upon contact of the cap 32 with the head unit 1, owing to the presences of the highly rigid portion 36 and the upwardly convexed portion of the upper end 32Ba of the partition wall 32B, which are both located above the through-hole 23.

Figure 9:
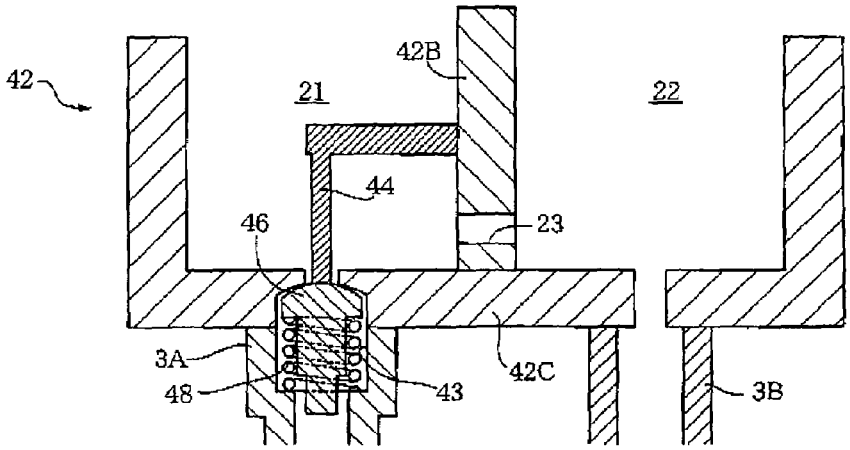

FIG. 9 shows still another embodiment of the invention in which the above-described receiver cap 2 is replaced by a receiver cap 42 including a partition wall 42B that is substantially identical in construction with the partition wall 2B of the cap 2. The cap 42 is different from the cap 2 in that the cap 42 is additionally provided with a via-detour discharger which is operable when the cap 42 is separated from the head unit 1, to discharge the ink stored in the ink storage chamber 21 as a first chamber, via a detour, namely, via the communication through-hole 23, the ink storage camber 22 as a second chamber and the ink discharge passage (second discharge passage) defined by the passage defining pipe 3B. The via-detour discharger includes a first-discharge-passage closer operable when the cap 42 is separated from the head unit 1, to close the ink discharge passage (first discharge passage) defined by the passage defining pipe 3A.

In this embodiment, the first-discharge-passage closer is constituted principally by a valve mechanism which includes a valve body 46 and a coil spring 48 as a biaser. The valve body 46 and the coil spring 48 are accommodated in a valve accommodation chamber 43 formed in a portion of a bottom wall 42C of the cap 42 in which portion the first discharge passage defined by the passage defining pipe 3A faces the first ink storage chamber 21. The coil spring 48 is mounted on a stem portion of the valve body 46, and constantly biases upwardly, i.e., in a direction that causes a head portion of the valve body 46 to be held in contact with a valve seat which is provided by an upper end portion of an inner wall of the valve accommodation chamber 43. With the head portion of the valve body 46 being thus seated in the valve seat, namely, with the cap 42 being separated from the head unit 1, the first discharge passage defined by the passage defining pipe 3A is closed. FIG. 9 illustrates this state in which the first discharge passage is closed the valve mechanism. On the other hand, when the cap 42 is brought into contact with the head unit 1, the partition wall 42B is downwardly displaced. In this instance, as a result of the downward displacement of the partition wall 42B, the valve body 46 is pushed downwardly through a valve pusher 44 which is fixed to the partition wall 42B, so as to be moved against a biasing force generated by the coil spring 48. It is noted that the valve pusher 44 is provided by a generally L-shaped member and includes a horizontally-extending holder portion and a vertically-extending rod portion. The valve pusher 44 is connected or held at its horizontally-extending holder portion by the partition wall 42B, and is held in contact at its vertically-extending rod portion with the head portion of the valve body 46.

In this embodiment of FIG. 9, owing to the provision of the via-detour discharger, the ink stored in the ink storage chamber 21 can be further reliably mixed into the ink stored in the ink storage chamber 22, before being discharged toward the drain tank. It is noted that the first-discharge-passage closer of the via-detour discharger may be provided by, in place of the above-described valve mechanism disposed between the first ink storage chamber 21 and the first discharge passage, another valve mechanism which is built in the suction pump 4 so as to be operable, for example, by means of an electromagnetic actuator, to selectively open and close first discharge passage, namely, to selectively permitting and inhibiting communication between the first ink storage chamber 21 and the chamber of the suction pump 4.

Figure 10:
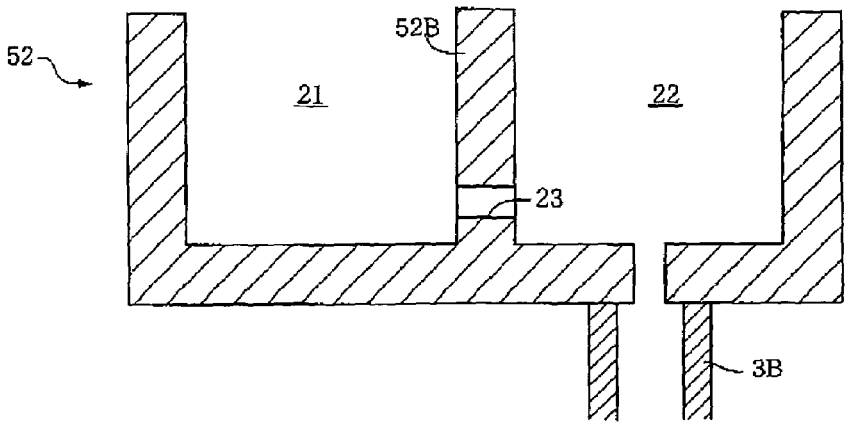
FIG. 10 is a cross sectional view of the cap in an arrangement according to a further embodiment of the invention, in which the communication through-hole formed through the partition wall is constantly open.

FIG. 10 shows a further embodiment of the invention in which the above-described receiver cap 2 is replaced by a receiver cap 52 which is different from the above-described receiver caps 2, 42 in that the cap 52 is connected to the suction pump 4 through only the passage defining pipe 3B. That is, the ink storage chamber 21 is not directly communicated with the chamber of the suction pump 4, but is communicated with the chamber of the suction pump 4, via the communication through-hole 23, the ink storage chamber 22 and the ink discharge passage defined by the passage defining pipe 3B. Further, unlike the partition walls 2B, 32B, 42B of the receiver caps 2, 42, a partition wall 52B of the cap 52 has an upper end whose height is substantially the same as the height of a circumferential wall of the cap 52. The partition wall 52B of the cap 52 is fixed at its lower end to a bottom wall of the cap 52, and is fixed at its opposite side ends to the circumferential wall of the cap 52. The communication through-hole 23 is always held open, irrespective of whether the cap 52 is in contact with or separated from the head unit 1. In this sense, the partition wall 52B, which defines the communication through-hole 23 in its lower portion, does not have to be made of an elastically deformable material. The partition wall 52B can be formed integrally with the circumferential and bottom walls, so that the cap 52 as a whole can be manufactured at a lower cost than the caps 2, 42.

In this embodiment of FIG. 10, owing to absence of the ink discharge passage directly communicating the ink storage chamber 21 and the chamber of the suction pump 4, and the presence of the communication through-hole 23 held always opened, the ink stored in the ink storage chamber 21 can be further reliably mixed into the ink stored in the ink storage chamber 22, before being discharged toward the drain tank.

While the presently preferred embodiments of the present invention have been described above in detail, it is to be understood that the invention is not limited to the details of the illustrated embodiments, but may be otherwise embodied.

For example, in the above-described embodiments (except the embodiment of FIG. 10), the upper end of the partition wall (2B, 32B, 42B) of the receiver cap (2, 32, 42) has a larger height than the upper end of the circumferential wall of the receiver cap. However, the upper end of the partition wall (2B, 32B, 42B) may have substantially the same height as the upper end of the circumferential wall, where the nozzle opening surface of the head unit (1) is arranged to include a downwardly protruding portion in its portion with which the partition wall (2B, 32B, 42B) is to be brought into contact. In this arrangement, too, it is possible to cause the upper end of the partition wall (2B, 32B, 42B) to be brought into contact with the head unit (1) earlier than the upper end of the circumferential wall, when the cap (2, 32, 42) is placed into the contact state from the separate state.

Further, in the above-described embodiments (except the embodiment of FIG. 10), the partition wall (2B, 32B, 42B) of the receiver cap (2, 32, 42) is arranged to be elastically deformable upon contact of the receiver cap (2, 32, 42) with the head unit (1). However, for closing the communication through-hole (23, 23'), the circumferential wall of the receiver cap (2, 32, 42) may be arranged to be elastically deformable together with the partition wall (2B, 32B, 42B). In this arrangement, the upper end of the partition wall (2B, 32B, 42B) may have substantially the same height as the upper end of the circumferential wall.

What is claimed is:

1. An inkjet printer comprising:

(a) a head unit having a plurality of ejecting portions and operable to eject a plurality of kinds of inks through said plurality of ejecting portions, respectively;

(b) a discharger operable to discharge the plurality of kinds of inks through said plurality of ejecting portions of said head unit; and (c) a communication controller, wherein said discharger includes:

(b-1) a cap selectively placeable in a contact state in which said cap is held in contact with said head unit, and in a separate state in which said cap is separated from said head unit;

(b-2) a suction pump operable to generate a suction pressure within said cap; and (b-3) a connector connecting said cap and said suction pump, wherein said cap defines therein a plurality of ink storage chambers in which the respective kinds of inks are to be stored, wherein said connector includes a plurality of passage definers defining respective discharge passages each of which communicates a corresponding one of said ink storage chambers and a chamber of said suction pump, wherein said communication controller allows communication between at least two of said plurality of ink storage chambers when said cap is placed in said separate state, and inhibits the communication between said at least two ink storage chambers when said cap is placed in said contact state, wherein said cap has a partition wall by which said at least two ink storage chambers are separated from each other, wherein said communication controller selectively allows and inhibits the communication between said at least two ink storage chambers through said partition wall, and wherein said communication controller is provided by said partition wall which defines a communication through-hole establishing therethrough the communication between said at least two ink storage chambers, such that said communication through-hole is open when said cap is placed in said separate state and is closed when said cap is placed in said contact state.

2. The inkjet printer according to claim 1, wherein said partition wall includes an elastically deformable portion in which said communication through-hole is formed such that said through-hole is selectively open and closed by elastic deformation of said elastically deformable portion.

3. The inkjet printer according to claim 2, wherein said cap includes a bottom wall and two mutually opposed side walls extending vertically from said bottom wall, such that said partition wall is disposed between said two mutually opposed side walls, wherein said partition wall is fixed at a lower end thereof to said bottom wall, while being held in fluid-tight contact at opposite side ends thereof with said mutually opposed side walls, such that said partition wall is vertically slidable relative to said mutually opposed side walls, and wherein said elastically deformable portion of said partition wall is elastically deformable for permitting slide movement of said partition wall relative to said mutually opposed side walls.

4. The inkjet printer according to claim 3, wherein said partition wall includes upper and lower portions each of which is made of a rubber or material similar to the rubber, wherein said lower portion provides an easily deformable portion which is elastically deformable easier than said upper portion, and wherein said upper portion provides a highly rigid portion which has a higher rigidity than said easily deformable portion, and which causes said easily deformable portion to be elastically deformed when said highly rigid portion is pressed downwardly by said head unit upon contact of said cap with said head unit.

5. The inkjet printer according to claim 3, wherein said partition wall has an upper end, and wherein said upper end of said partition wall is located an upper side of an upper end of each of said two mutually opposed side walls, when said cap is placed in said separate state.

6. The inkjet printer according to claim 1, wherein said cap includes a bottom wall and two mutually opposed side walls extending vertically from said bottom wall, such that said partition wall is disposed between said two mutually opposed side walls, wherein said partition wall is fixed at a lower end thereof to said bottom wall while being fixed at opposite side ends thereof to said mutually opposed side walls, wherein said partition wall is made of a rubber or material similar to the rubber, and wherein said communication through-hole is formed in a portion of said partition wall which is distant from said mutually opposed side walls.

7. The inkjet printer according to claim 6, wherein said partition wall includes a highly rigid portion having a higher rigidity than a portion of said partition wall which is other than said highly rigid portion, and wherein said highly rigid portion is located above said communication through-hole.

8. The inkjet printer according to claim 7, wherein said highly rigid portion is provided by a highly rigid member which is embedded in said partition wall, and wherein said highly rigid member has a higher rigidity than a material forming said portion which is other than said highly rigid portion.

9. The inkjet printer according to claim 6, wherein said partition wall has an upper end which is upwardly convexed, such that a portion of said upper end distant from said mutually opposed side walls is located on an upper side of a portion of said upper end close to each of said mutually opposed side walls.

10. An inkiet printer comprising:

(a) a head unit having a plurality of ejecting portions and operable to eject a plurality of kinds of inks through said plurality of ejecting portions, respectively;

(b) a discharger operable to discharge the plurality of kinds of inks through said plurality of ejecting portions of said head unit; and (c) a communication controller, wherein said discharger includes:

(b-1) a cap selectively placeable in a contact state in which said cap is held in contact with said head unit, and in a separate state in which said cap is separated from said head unit;

(b-2) a suction pump operable to generate a suction pressure within said cap; and (b-3) a connector connecting said cap and said suction pump, wherein said cap defines therein a plurality of ink storage chambers in which the respective kinds of inks are to be stored, wherein said connector includes a plurality of passage definers defining respective discharge passages each of which communicates a corresponding one of said ink storage chambers and a chamber of said suction pump, wherein said communication controller allows communication between at least two of said plurality of ink storage chambers when said cap is placed in said separate state, and inhibits the communication between said at least two ink storage chambers when said cap is placed in said contact state, wherein said cap has a partition wall by which said at least two ink storage chambers are separated from each other, and wherein said communication controller selectively allows and inhibits the communication between said at least two ink storage chambers through a portion of said partition wall which is closer to a lower end of said partition wall than to an upper end of said partition wall.

11. The inkjet printer according to claim 1, wherein said cap defines, as one of said at least two chambers, a pigment-ink storage chamber in which a pigment ink as one of the plurality of kinds of inks is to be stored, and wherein said cap defines, as another one of said at least two chambers, a dye-ink storage chamber in which a dye ink as another one of the plurality of inks is to be stored.

12. An inkiet printer comprising:

(a) a head unit having a plurality of ejecting portions and operable to eject a plurality of kinds of inks through said plurality of ejecting portions, respectively;

(b) a discharger operable to discharge the plurality of kinds of inks through said plurality of ejecting portions of said head unit; and (c) a communication controller, wherein said discharger includes:

(b-1) a cap selectively placeable in a contact state in which said cap is held in contact with said head unit, and in a separate state in which said cap is separated from said head unit;

(b-2) a suction pump operable to generate a suction pressure within said cap; and (b-3) a connector connecting said cap and said suction pump, wherein said cap defines therein a plurality of ink storage chambers in which the respective kinds of inks are to be stored, wherein said connector includes a plurality of passage definers defining respective discharge passages each of which communicates a corresponding one of said ink storage chambers and a chamber of said suction pump, wherein said communication controller allows communication between at least two of said plurality of ink storage chambers when said cap is placed in said separate state, and inhibits the communication between said at least two ink storage chambers when said cap is placed in said contact state, wherein said discharger includes a via-detour discharger operable when said cap is placed in said separate state, to discharge an ink as one of the plurality of kinds of inks stored in a first chamber as one of said at least two ink storage chambers, via a detour, and wherein said detour is provided by a second chamber as another one of said at least two ink storage chambers which is brought into communication with said first chamber by said communication controller, and a second discharge passage as one of said discharge passages which communicates said second chamber and said chamber of said suction pump.

13. The inkjet printer according to claim 12, wherein said via-detour discharger includes a first-discharge-passage closer operable when said cap is placed in said separate state, to close a first discharge passage as another one of said discharge passages which communicates said first chamber and said chamber of said suction pump.

14. The inkjet printer according to claim 13, wherein said cap has a partition wall by which said at least two ink storage chambers are separated from each other, wherein said communication controller is provided by said partition wall which defines a communication through-hole establishing therethrough a communication between said at least two ink storage chambers, wherein said partition wall includes an elastically deformable portion in which said communication through-hole is formed such that said through-hole is selectively open and closed by elastic deformation of said elastically deformable portion, and wherein said first-discharge-passage closer closes said first discharge passage when said communication through-hole is open.

15. The inkjet printer according to claim 12, wherein said first chamber is a dye-ink storage chamber in which a dye ink as one of the plurality of kinds of inks is to be stored, and wherein said second chamber is a pigment-ink storage chamber in which a pigment ink as another one of the plurality of kinds of inks is to be stored.

16. An inkjet printer comprising:

(a) a head unit having a plurality of ejecting portions and operable to eject a plurality of kinds of inks through said plurality of ejecting portions, respectively; and (b) a discharger operable to discharge the plurality of kinds of inks through said plurality of ejecting portions of said head unit;

wherein said discharger includes:

(b-1) a cap selectively placeable in a contact state in which said cap is held in contact with said head unit, and in a separate state in which said cap is separated from said head unit;

(b-2) a suction pump operable to generate a suction pressure within said cap; and (b-3) a connector connecting said cap and said suction pump, wherein said cap defines therein a plurality of ink storage chambers in which the respective kinds of inks are to be stored, wherein said cap has a partition wall by which a first chamber as one of said plurality of ink storage chambers and a second chamber as another of said plurality of ink storage chambers are separated from each other, wherein said connector includes a passage definer defining a discharge passage which communicates one of said first and second chambers and a chamber of said suction pump, and wherein said partition wall defines, in a lower portion thereof, a communication through-hole establishing therethrough a communication between said first and second chambers, such that an ink as one of the plurality kinds of inks stored in the other of said first and second chambers, as well as an ink as another one of the plurality of kinds of inks stored in said one of said first and second chambers, can be discharged through said discharge passage.

* * * * *